United States Patent [19]

Andersson et al.

[11] Patent Number: 4,505,053

[45] Date of Patent: Mar. 19, 1985

[54] DRYING PLANT FOR A MATERIAL WEB

[75] Inventors: Karl-Hugo Andersson; Ingemar Karlsson, both of Växjö , Sweden; Rolf Quick, Ottawa, Canada

[73] Assignee: Flakt AB, Nacka, Sweden

[21] Appl. No.: 429,233

[22] Filed: Sep. 30, 1982

[30] Foreign Application Priority Data

Oct. 19, 1981 [SE] Sweden ..... 8106152

[51] Int. Cl.[3] ..... F26B 13/20

[52] U.S. Cl. ..... 34/155; 34/156; 34/160

[58] Field of Search ..... 34/155, 156, 160; 226/97

[56] References Cited

U.S. PATENT DOCUMENTS

| | | | |
|---|---|---|---|
| 3,008,243 | 11/1961 | Kawaguchi | 34/160 |
| 3,070,901 | 1/1963 | Allander et al. | 34/160 |
| 3,982,328 | 9/1976 | Gustafsson et al. | 34/160 |
| 4,058,244 | 11/1977 | Vits | 34/156 |
| 4,290,210 | 9/1981 | Johansson | 34/156 |
| 4,292,745 | 10/1981 | Caratsch | 34/156 |

FOREIGN PATENT DOCUMENTS

| | | | |
|---|---|---|---|
| 703283 | 2/1954 | United Kingdom | 34/160 |

*Primary Examiner*—Larry I. Schwartz
*Assistant Examiner*—David W. Westphal
*Attorney, Agent, or Firm*—Oblon, Fisher, Spivak, McClelland & Maier

[57] ABSTRACT

The invention relates to a plant for drying a material web. Such plant includes a plurality of upper (3) and lower blow boxes arranged substantially mutually parallel and at right angles to the travelling direction of the web. The lower boxes are intended to support the web and are provided in their surfaces facing towards the web with orifices for blowing air in directions substantially parallel to the plane of the web. The air ejection velocity is thereby sufficient to maintain the web in a specified floating position above said boxes. The upper blow boxes (3) are situated on the other side of the material web and have orifices for blowing air substantially perpendicularly to the plane of the web. According to the invention, the distance (H) between the blowing orifices of the upper blow boxes and the web is variable. It is furthermore adjustable so that the relative energy requirement for the upper blow boxes may be brought closely into the region of the value 1. The variable distance (H) may be provided, in accordance with one embodiment of the invention, by the upper blow boxes (3) being at one end (6) pivotably mounted in a wall (7) of a compressed air chamber, while their other ends (8) are movable in height for adjusting the distance (H) to the underlying, fixed web-positioning blow box (4).

11 Claims, 7 Drawing Figures

DRYING PLANT FOR A MATERIAL WEB

Figure 1:
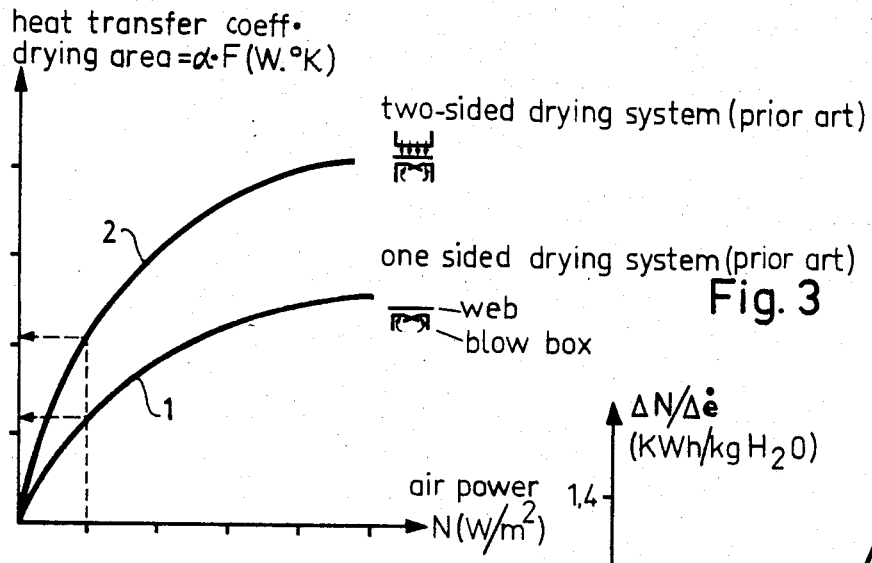

The present invention relates to a drying plant for a material web, said plant including a plurality of upper and lower blow boxes arranged substantially mutually parallel and at right angles to the advancing direction of the web. The lower boxes are intended for supporting the web, and in their surfaces facing towards the web they are provided with orifices for blowing out air in directions substantially parallel to the plane of the web, the discharge velocity of the air being sufficient to maintain the web in a given floating position above the boxes. The upper blow boxes are situated above the web and have orifices for blowing out air substantially at right angles to the plane of the web.

Plants of the kind just described are well-known in the art and have been installed in a number of paper-making mills in different countries.

Common to all these drying plants is that the drying air keeps the material web floating at a specified level above the respective blow boxes, as well as transferring the necessary heat for evaporating the water in the web, the resulting vapour being entrained in the air stream and taken away. That the web can be stabilized to a definite floating position above the lower blow boxes is due to the fact that air currents blown out between two surfaces, and parallel to them, give rise to a force pulling the surfaces towards each other, until the distance between them becomes so small that the pressure drop for the flow is in equilibrium with the force of attraction. The blowing-out velocity parallel to the plane of the web must attain at least 12 m/s to retain a material web in a particular specified floating position. This minimum value is approximately valid for different implementations of web-positioning blow boxes. It is, however, customary to use air velocities in the order of magnitude of 25–75 m/s.

In the art, and further to the kind of plant already mentioned, there are also dryers with one-sided blowing, where the lower blow boxes by themselves are utilized for positioning and drying the material web. The advantage with these dryers is that the one-sided drying system gives the lowest specific power consumption per kilo evaporated liquid, as compared with dryers utilizing so-called two-sided blowing, i.e. with both upper and lower blow boxes. The disadvantage with the one-side dryers is that the plant becomes rather voluminous, since the web must be advanced a considerably greater distance in the dryer to enable a sufficient amount of water to evaporate. The two-side dryers are more compact, since the effective drying distance may be made shorter. On the other hand, however, the two-side dryers have a larger energy requirement per kilo evaporated liquid than those with the one-sided drying system. The reason for this is that so far it has not been possible to reduce the distance between upper and lower blow boxes to one which gives optimum heat transference, and thereby optimum drying effect, since primary consideration has had to be given to the need of keeping a reasonably large distance between the upper and lower blow boxes for access during inspection and cleaning, as well as clearing out the dryer after a web rupture, for example.

The object of the present invention is to enable a structure permitting considerably shorter drying distances than for a one-sided drying system, although at the same time having a relative energy consumption that is less than that for the two-sided system, and in certain cases even less than one-sided drying systems in the art.

This object is realized in accordance with the invention essentially by the distance between the blowing orifices of the upper blow boxes and the material web being variable and adjustable such that the relative energy consumption for the upper blow boxes may be brought to lie closely around the value of 1.

According to a suitable embodiment of the invention, each of the upper blow boxes is pivotally attached at one end to a wall of a compressed air chamber, its opposite end being movable in height for adjusting the distance thereof to the underlying, fixed web-positioning blow box.

Figure 3:
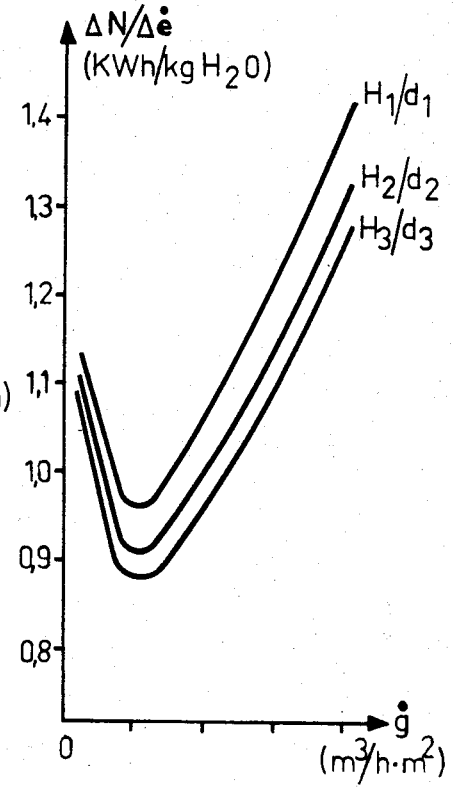
Figure 2:
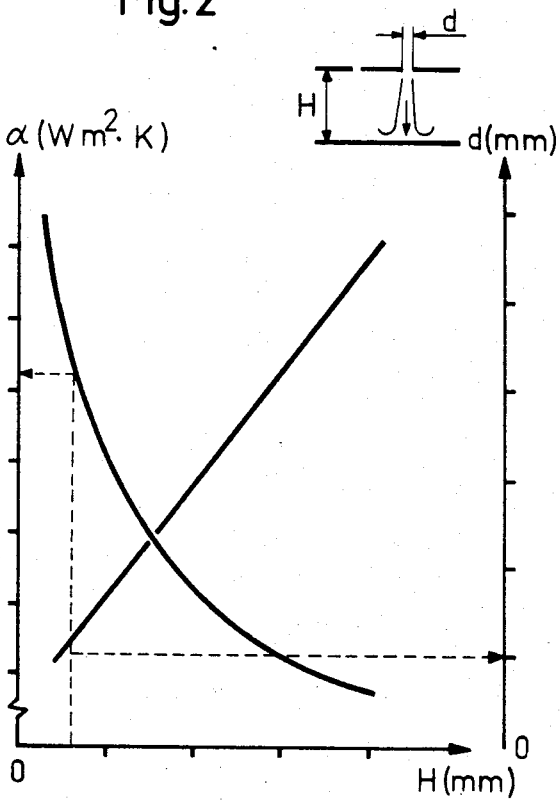
Figure 4:
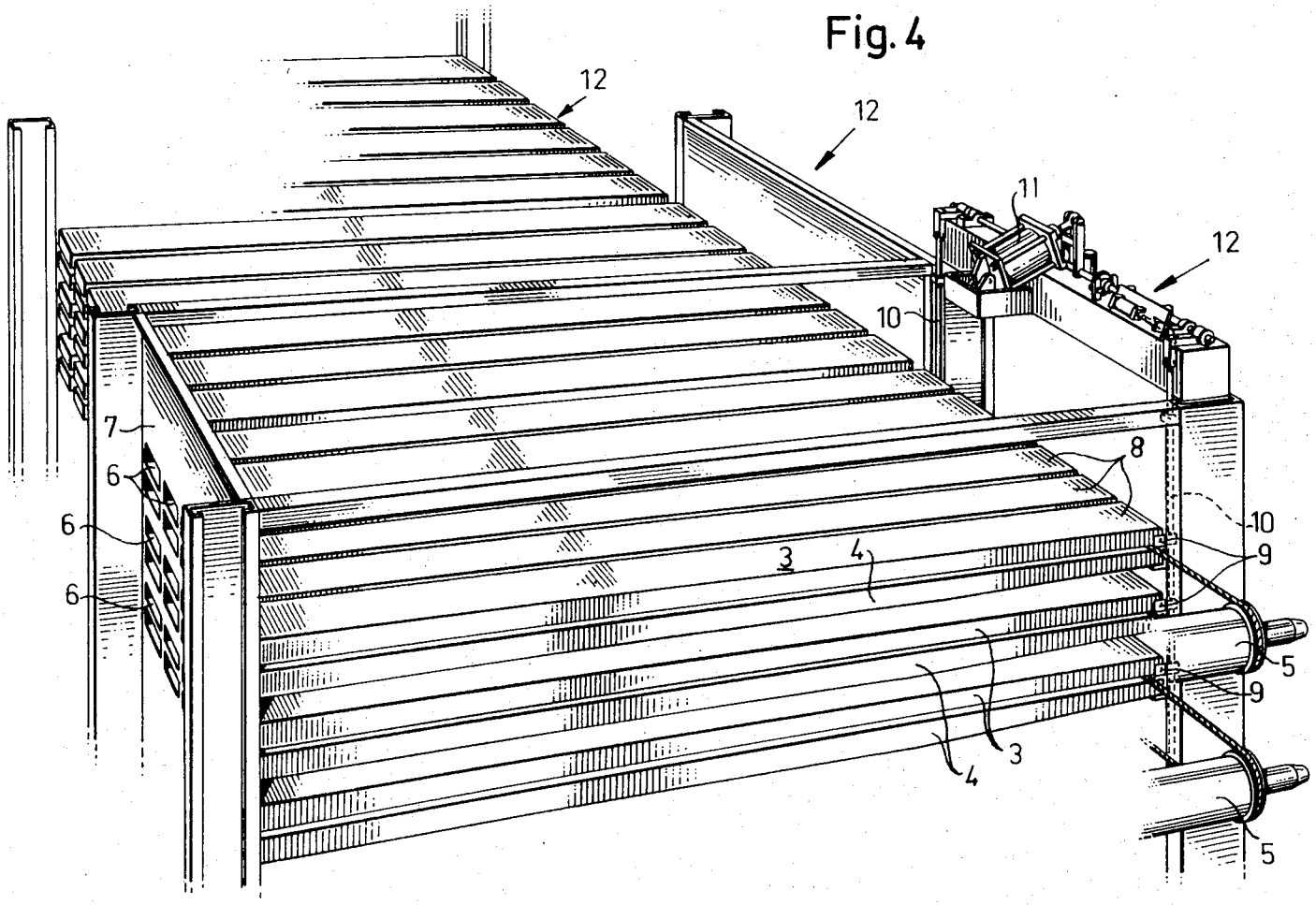
Figure 5:
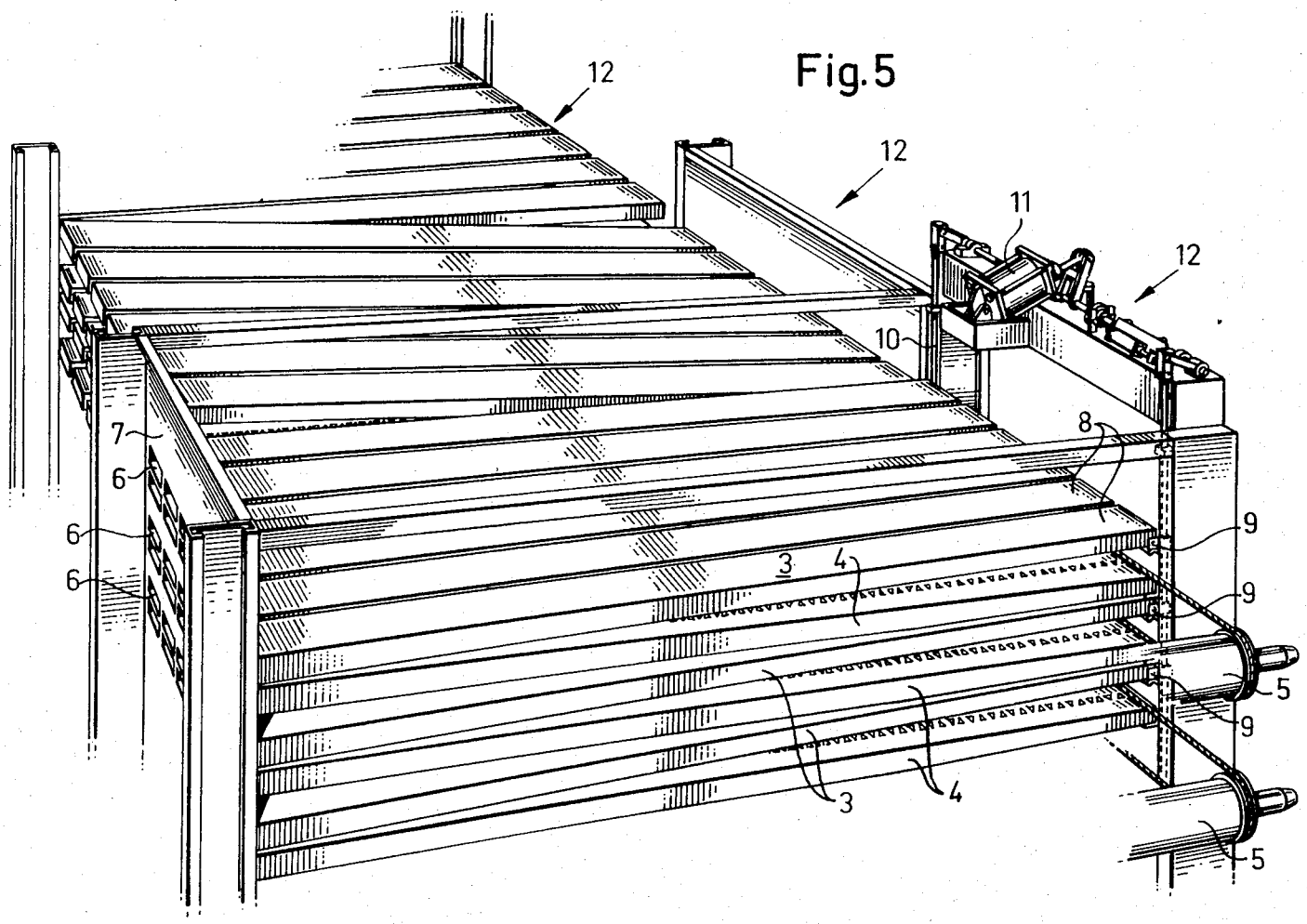
Figure 6A:
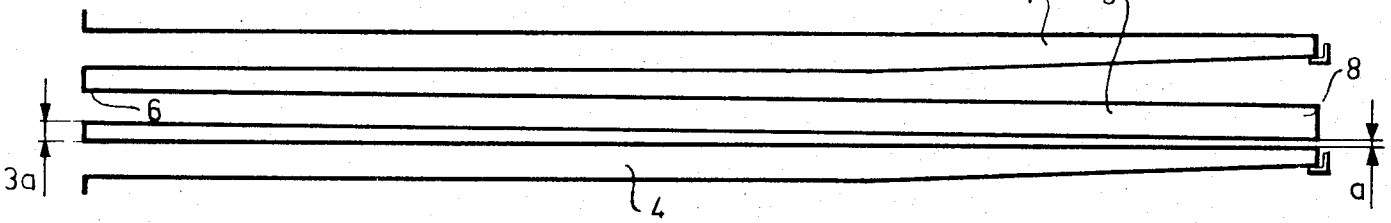
Figure 6B:
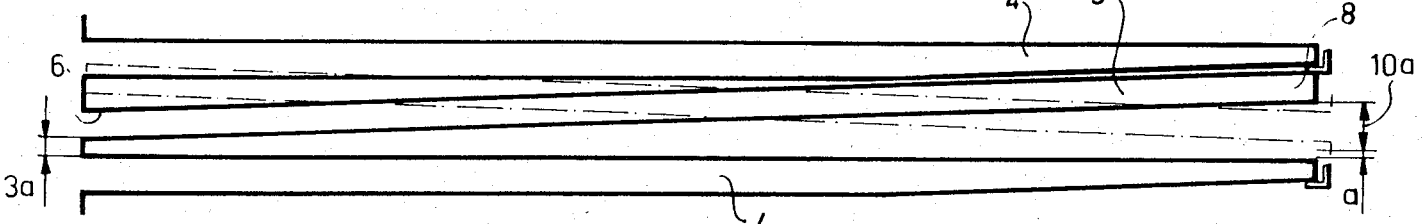

An embodiment of the invention, selected as an example, will now be described below with reference to the appended drawings, on which FIG. 1 shows graphs of the heat transfer coefficient as a function of the sacrificed air power for a one-sided and a two-sided drying system of known type, FIG. 2 is a nomogram of the heat transfer coefficients for a known two-sided type of drying system when the system geometry is changed, FIG. 3 illustrates the relative energy consumption as a function of the specific air flow when the system geometry is changed according to FIG. 2, FIG. 4 schematically illustrates a portion of a plant in accordance with the invention where the upper blow boxes are in a lowered position at constant mutual spacing, FIG. 5 illustrates the plant in accordance with the invention with the upper blow boxes in a raised position, FIGS. 6*a* and 6*b* schematically illustrate an alternative implementation of the plant according to FIGS. 4 and 5, and also the spacing relationships between the upper and lower blow boxes when the former are in the raised and lowered positions, respectively.

FIG. 1 illustrates the heat transfer coefficient $\alpha$ times the drying surface F (expressed in W/°K.) as a function of the delivered air power N (expressed in $W/m^2$). Graph 1 in the Figure illustrates the functional relationship for a known type of one-sided drying system, where the paper web is maintained in a given floating position above the blow box with the aid of air currents blown out in directions substantially parallel to the web. The other graph 2 illustrates the functional relationship for a two-sided drying system of known type, where the paper web, as for the case with the one-sided drying system, is supported with the aid of blow boxes providing parallel air currents, the upper blow boxes being provided with orifices for blowing out air perpendicular to the web at the same time. As will be seen from the graphs, it is considerably more favourable to sacrifice a given amount of air power in a two-sided drying system than in a one-sided drying system. Two-side dryers with a given air gap H between the upper blow box and the web have, however, a greater energy requirement per unit weight of evaporated liquid than the one-sided drying system, which is associated with the fact that the distance H must be made sufficiently large in the prior art to give access for cleaning out the dryer after web rupture. The one-sided drying system has thus had the lowest relative energy requirement per unit weight of evaporated liquid. The reason why the relative energy requirement in a one-sided system cannot be reduced still further is that a certain minimum air power is needed for maintaining the material web in a specified floating position above the lower blow boxes for providing an assured (i.e., contactless) advance of the web through the dryer.

According to the invention it has been established for the upper blow boxes that if the air gap H is decreased for a given air power, simultaneously as the size and distribution of the perforations are changed, then the heat transfer coefficient $\alpha$ increases in the manner discernable from FIG. 2. The coefficient $\alpha$ denotes the convective heat transfer coefficient in $W/m^2{}^\circ K$. If the air gap H is decreased at the same time as the diameter d of the air-blowing orifice is decreased to a given value, a point will successively be reached where, for a given amount of air power delivered, the air power required for evaporating each unit weight of liquid will be less in a two-sided drying system than in a one-sided one. In FIG. 3 the relative energy requirement $\Delta N/\Delta e$, expressed in KWh/kg $H_2O$, has been plotted as a function of the specific air flow g, expressed in $m^3/h{\cdot}m^2$. The letter N denotes the energy requirement for generating a given flow and pressure for the air blown out. The letter e denotes the specific evaporation expressed in kg $H_2O/m^2h$. From the graphs in the Figure it will be seen that at a given specific air flow a relative energy requirement is attained, which falls below 1 for all the illustrated cases. This means that more drying effect has been enabled for the upper blow boxes at a given air power, compared with a system having one-sided blowing.

FIG. 4 perspectively illustrates a portion of a drying plant in accordance with the invention, where a material web is intended for advancement between upper 3 and lower 4 blow boxes vertically arranged in pairs with one pair of boxes above the other, so that the web is taken zig-zag through the dryer and passes over the reversing rolls 5 at either end of it. The plant is built up in blocks or vertical sections 12. In each section, the end portions 6 of the upper blow boxes 3 are pivotally mounted in a wall 7 of a compressed air chamber, shown open in the Figure, but in reality closed and connected to a blower. The opposite ends 8 of these blow boxes are movable in height and in the respective horizontal group each end 8 is attached to a beam 9. The beam 9 is in turn attached at either end to a vertically displaceable operating rod 10, the rods being intended for actuation by an operating means 11 disposed above the uppermost group of blow boxes. The Figure illustrates the embodiment with the ends 8 in their lowered position, the upper and lower blow boxes then being parallel, which is the situation during operation of the dryer. The ends 8 may be put into their raised position by lifting the beams 9 with the aid of the operating means 11, via the operating rods 10. The drying plant shown on the Figure is built up by vertical sections 12 of blow boxes, the sections being arranged in a row in the direction of web travel. The means 11 may be energized for individual operation in each section 12, or for simultaneous operation in all the sections. The movable ends 8 and associated operating equipment are placed on alternate sides of the sections. The arrangement of the upper blow boxes described above facilitates the labour of cleaning out the dryer and is absolutely necessary for cleaning dryers where the web width may be in the region of 10 meters, when, in accordance with the invention, small distances between upper and lower blow boxes are used.

The plant of FIG. 4 is illustrated in FIG. 5 with the ends 8 of the blow boxes 3 in their raised position, and it will be clearly seen from the Figure how said ends are raised on alternate sides of the sections 12. The operating means 11 and associated equipment have only been depicted once in each of the Figures, but are of course arranged on the appropriate side of each section 12.

In FIGS. 6*a* and 6*b* there is schematically shown an alternative implementation of the plant according to FIGS. 4 and 5. In this case the distance between the upper and lower blow boxes varies across the web when the upper boxes are in their lowered position. It will be seen from the Figures how the drying plant and blow boxes are arranged, as seen in end elevation of the dryer, and with the relations in distances applicable between the blow boxes. In FIG. 6*a* the upper boxes 3 are lowered to their normal operating position, where the movable end has a minimum distance a to the underlying box 4, this distance being less than the corresponding fixed distance 3*a* for the pivotally mounted end. In FIG. 6*b* the distances are shown when the upper box 3 is in its raised position, the movable end having a maximum distance of 11*a* to the lower box 4, which is considerably greater than the corresponding fixed distance 3*a* for the pivotably mounted end, and is partly achieved by tapering a portion of the lower blow box 4. FIG. 6*b* has also been provided with chain-dotted lines indicating the raised position of the upper blow boxes in an adjacent section. By this arrangement a varying air gap across the width of the web is obtained during normal operation. The reason for this is that, due to the difficulties in cleaning etc, it is not desired to have a fixed distance which is as small as the minimum adjustable distance. Since the sections have the movable blow box ends 8 on alternate sides, as seen in the direction of web travel, the lateral taper of the air gap is reversed from section to section and possible variation in the moisture content across the web in one section is substantially evened-out during drying in the next one. However, the arrangement with a varying air gap is not necessary for realizing the inventive concept. Neither is the invention restricted to raising one end of the upper blow boxes, and the plant can very well be provided with the lifting means on both sides of each section for raising the upper blow boxes parallel to the lower ones.

We claim:

1. A plant for drying a material web by two-sided blowing, said plant comprising:

(a) a plurality of lower blow boxes which support the material web during use of the plant, said lower blow boxes being provided with orifices for blowing air substantially exclusively in directions which are generally opposite to one another and substantially in parallel to the plane of the material web, the air ejection velocity being sufficient to maintain the material web at a specified floating height above said lower blow boxes during use of the plant and the material web being stabilized at a definite floating position of said lower blow boxes due to the fact that air currents blown out between the upper surface of said lower blow boxes and the lower surface of the material web and parallel to both surfaces give rise to a force pulling the surfaces towards each other until the distance between the two surfaces becomes so small that the pressure drop due to the flow of the air is in equilibrium with the force of attraction;

(b) a plurality of upper blow boxes situated on the opposite side of the material web from said lower blow boxes, said upper blow boxes being provided with orifices having a diameter (d) for blowing air substantially exclusively at right angles to the plane of the material web;

(c) first means for adjusting the distance (H) from the orifices in said upper blow boxes to the material web so that the ratio (H/d) between the distance (H) and the diameter (d) is an optimal heat transfer coefficient ($\alpha$); and (d) means for generating a specific airflow (g) through said upper blow boxes such that the relative energy requirement ($\Delta N/\Delta e$) expressed in KWh/kg $H_2O$, which is the ratio of the change in energy requirement for generating a certain air flow to the change in specific evaporation, is less than or equal to one, whereby the energy consumption per unit weight of evacuated liquid is substantially equal to what it would be for single-sided blowing.

2. A plant as recited in claim 1 wherein, during use of the plant, said upper and lower blow boxes are substantially parallel.

3. A plant as recited in claim 1 wherein, during use of the plant, said upper and lower blow boxes are arranged substantially at right angles to the travelling direction of the material web.

4. A plant as recited in claim 1 wherein the relative energy requirement ($\Delta N/\Delta e$) is less than one.

5. A plant as recited in claim 1 wherein said first means for adjusting the distance (H) from the orifices in said upper blow boxes to the material web comprise:

(a) second means for pivotably mounting one end of each of said upper blow boxes in a wall of a pressure chamber and (b) third means for moving the opposite end of each of said upper blow boxes vertically.

6. A plant as recited in claim 5 wherein:

(a) each of said opposite ends of said upper blow boxes is settable to a minimum distance from the adjacent lower blow box and (b) said minimum distance is less than the corresponding fixed distance from said second means to the adjacent lower blow box.

7. A plant as recited in claim 5 wherein:

(a) each of said opposite ends of said upper blow boxes is settable to a maximum distance from the adjacent lower blow box and (b) said maximum distance is greater than the corresponding fixed distance from said second means to the adjacent lower blow box.

8. A plant as recited in claim 5 wherein:

(a) said upper blow boxes are arranged in horizontal groups;

(b) said opposite ends of said upper blow boxes are operatively connected to one another;

(c) said horizontal groups of said upper blow boxes are arranged one above the other; and (d) said horizontal groups of said upper blow boxes are connected to a vertically displaceable operating rod.

9. A plant as recited in claim 8 wherein said vertically displaceable operating rod is actuated by an operating means situated above said horizontal groups of said upper blow boxes.

10. A plant as recited in claim 8 wherein:

(a) said horizontal groups of said upper blow boxes are arranged in vertical sections adjacent each other and (b) said opposite ends of adjacent ones of said horizontal groups of said upper blow boxes are on alternate sides of the material web during use of the plant.

11. A method of drying a material web by two-sided blowing using a plant comprising:

(a) a plurality of lower blow boxes which support the material web during use of the plant, said lower blow boxes being provided with orifices for blowing air substantially exclusively in directions which are generally opposite to one another and substantially in parallel to the plane of the material web, the air ejection velocity being sufficient to maintain the material web at a specified floating height above said lower blow boxes during use of the plant and the material web being stabilized at a definite floating position above said lower blow boxes due to the fact that air currents blown out between the upper surfaces of said lower blow boxes and the lower surface of the material web and parallel to both surfaces give rise to a force pulling the surfaces towards each other until the distance between the two surfaces becomes so small that the pressure drop due to the flow of the air is in equilibrium with the force of attraction, and (b) a plurality of upper blow boxes situated on the opposite side of the material web from said lower blow boxes, said upper blow boxes being provided with orifices having a diameter (d) for blowing air substantially exclusively at right angles to the plane of the material web, said method comprising the steps of:

(c) adjusting the distance (H) from the orifices in said upper blow boxes to the material web so that the ratio (H/d) between the distance (H) and the diameter (d) is an optimal heat transfer coefficient ($\alpha$); and (d) generating a specific air flow (g) through said upper blow boxes such that the relative energy requirement ($\Delta N/\Delta e$) KWh/kg $H_2O$, which is the ratio of the change in energy requirement for generating a certain air flow to the change in specific evaporation, is less than or equal to one, whereby the energy consumption per unit weight of evacuated liquid is substantially equal to what it would be for single-sided blowing.

* * * * *